US011122838B2

(12) United States Patent
Wu

(10) Patent No.: US 11,122,838 B2
(45) Date of Patent: Sep. 21, 2021

(54) ELECTRONIC CIGARETTE

(71) Applicant: SHENZHEN SMOORE TECHNOLOGY LIMITED, Guangdong (CN)

(72) Inventor: Zhenyu Wu, Guangdong (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 187 days.

(21) Appl. No.: 16/362,858

(22) Filed: Mar. 25, 2019

(65) Prior Publication Data

US 2019/0364967 A1 Dec. 5, 2019

(30) Foreign Application Priority Data

May 29, 2018 (CN) ..... 201820810195.X

(51) Int. Cl.
*F22B 1/28* (2006.01)
*A24F 47/00* (2020.01)

(52) U.S. Cl.
CPC ..... *A24F 47/008* (2013.01)

(58) Field of Classification Search
CPC ..... C23C 16/4481; F22B 1/282
USPC ..... 165/164; 392/450
See application file for complete search history.

(56) References Cited

U.S. PATENT DOCUMENTS 3,270,182 A * 8/1966 Hynes ..... F24H 3/0405 392/492
7,106,957 B2 * 9/2006 Abras ..... F28D 7/0041 392/480
9,676,251 B2 * 6/2017 Yokoyama ..... H05B 3/24
2020/0318595 A1 * 10/2020 Huettner ..... F02M 21/0248
2020/0352242 A1 * 11/2020 Lawson ..... A24F 40/46

* cited by examiner

*Primary Examiner* — Phoung Chi Thi Nguyen
(74) *Attorney, Agent, or Firm* — Ladas & Parry LLP

(57) ABSTRACT

The present disclosure relates to an electronic cigarette, including an atomizing device and a power device, the power device is connected to the atomizing device and supplies power to the atomizing device, such that the atomizing device atomizes e-liquid and generate smoke. The power device includes a stand and a liquid accumulating member provided at one end of the stand adjacent to the atomizing device, one side of the liquid accumulating member adjacent to the atomizing device forms a liquid accumulating cavity used to store the e-liquid exuded by the atomizing device.

20 Claims, 4 Drawing Sheets

ELECTRONIC CIGARETTE

CROSS-REFERENCE TO RELATED APPLICATION

This application claims the benefit of Chinese Patent Application No. 201820810195X, filed May 29, 2018, the entire content of which is incorporated herein in its entirety.

TECHNICAL FIELD

The present disclosure is related to a substitute of cigarette, particularly relates to an electronic cigarette.

BACKGROUND

An electronic cigarette is also known as a virtual cigarette, or an electronic atomizer, which is a well-developed substitute of cigarette. An electronic cigarette has the similar appearance and taste of cigarette, but generally does not contain other harmful ingredients, such as tar and particulate matter, therefore the electronic cigarette is increasingly widely used.

During the use, transportation and storage of the electronic cigarette, the e-liquid leak to the side where the battery located, which may a fleet the function and use of the product.

SUMMARY

According to various embodiments of present disclosure, an electronic cigarette is provided.

An electronic cigarette includes an atomizing device and a power device. The atomizing device contains e-liquid. The power device is connected to the atomizing device and supplies power to the atomizing device, such that the atomizing device atomizes the e-liquid and generate smoke. The power device includes a stand and a liquid accumulating member provided at an end of the stand adjacent to the atomizing device, the liquid accumulating member is provided with a liquid storage cavity on a side thereof adjacent to the atomizing device, and the liquid accumulating cavity is used to store the e-liquid exuded by the atomizing device.

These and other objects, advantages, purposes and features will become apparent upon review of the following specification in conjunction with the drawings.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Embodiments of the present disclosure are described more fully hereinafter with reference to the accompanying drawings. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

It will be understood that when an element is referred to as being "fixed" to another element, it can be directly fixed to the other element or intervening elements may be present. Also, when an element is referred to as being "connected" or "coupled" to another element, it can be directly connected or coupled to the other element of intervening elements may be present. As used herein, the terms "inside", "outside", "left", "right" and the like are merely for the illustrative purpose.

Figure 1:
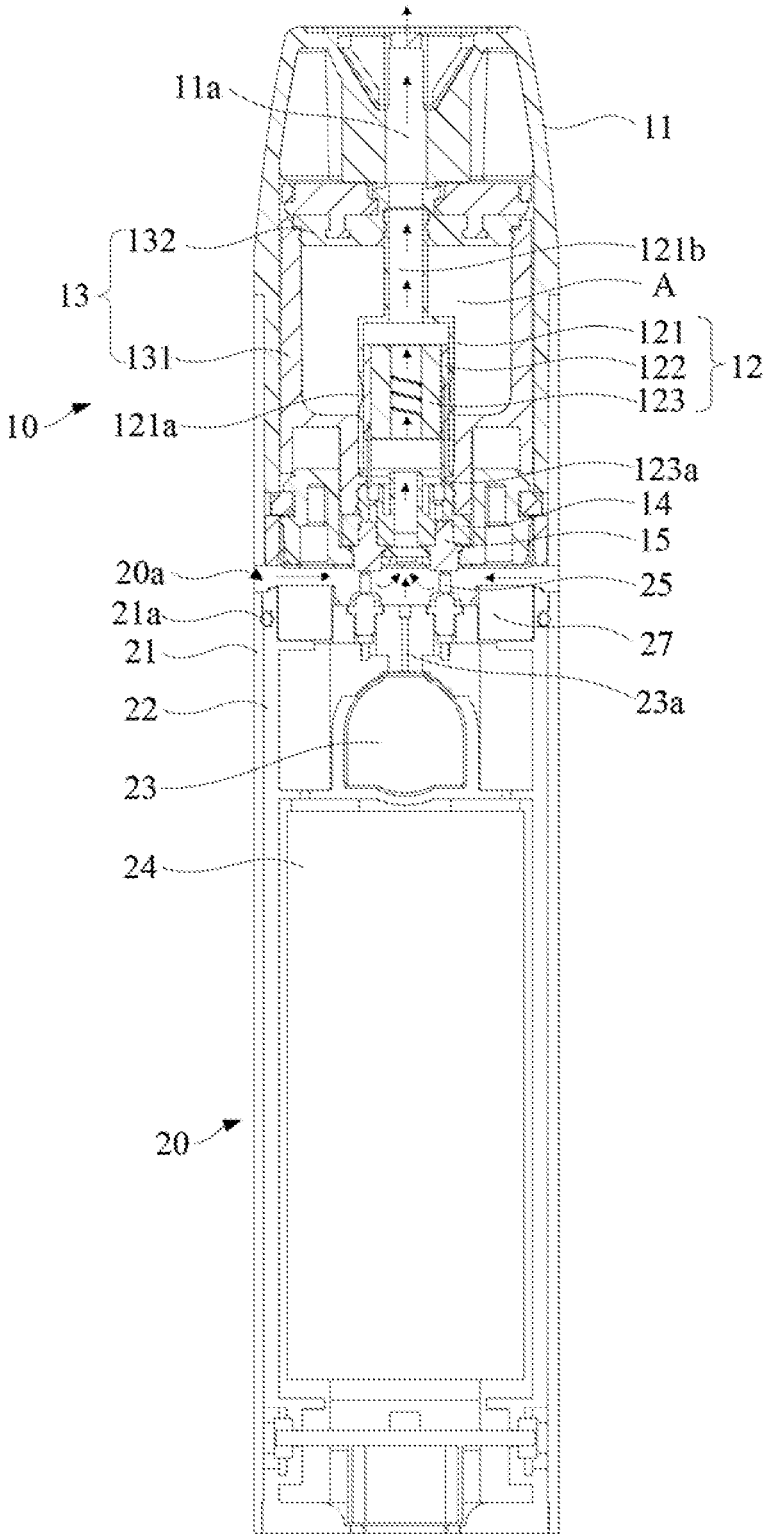
FIG. 1 is a cross-sectional view of an electronic cigarette according to an embodiment.

Referring to FIG. 1, an electronic cigarette according to an embodiment includes an atomizing device 10 and a power device 20. After the atomizing device 10 and the power device 20 are assembled, the power device 20 can supply power to the atomizing device 10, such that the atomizing device 10 atomizes e-liquid to generate smoke for an user to smoke.

In some embodiments, the atomizing device 10 includes a casing 11, an atomizing component 12, and a liquid storage component 13. The atomizing component 12 is connected to the liquid storage component 13, and is received in the casing 11 together with the liquid storage component 13. A liquid storage cavity A used to store the e-liquid is formed in the liquid storage component 13. Normally, the liquid storage cavity A is formed around the atomizing component 12, and the e-liquid in the liquid storage cavity A can flow into the atomizing component 12, and is then atomized by the atomizing component 12 to generate smoke.

A smoke channel 11*a* for the smoke to flow out is formed in the casing 11. The smoke channel 11*a* is in communication with a portion of the atomizing component 12 where the e-liquid is atomized, such that the smoke can flow out through the smoke channel 11*a* for user to inhale.

As shown in FIG. 1, the atomizing component 12 includes a fixing tube 121, a liquid absorbing member 122, and a heating member 123.

A liquid inlet 121*a* for the e-liquid to flow into the fixing tube 121 is formed on the fixing tube 121. The liquid absorbing member 122 is located in the fixing tube 121, such that the e-liquid flowing into the fixing tube 121 can be absorbed using the capillary effect of the liquid absorbing member 122. The liquid absorbing member 122 can be a tubular liquid absorbing cotton, or a tubular porous ceramic body.

The heating member 123 is located in the liquid absorbing member 122, such that the e-liquid absorbed by the liquid absorbing member 122 is heated and atomized by the heat generated by heating member 123. The heating member 123 can be at least one of a heating coating, a heating circuit, a heating sheet, and a heating mesh.

In the aforementioned embodiment, an end 121*b* of the fixing tube 121 away from the power device 20 shrinks (having a less diameter) and is in communication with the smoke channel 11*a*. When the e-liquid absorbed by the liquid absorbing member 122 is heated by the heating member 123, the e-liquid is atomized into smoke, therefore, when the user inhales at the smoke channel 11*a*, the smoke enters the smoke channel 11*a* through the fixing tube 121, then flows out of the smoke channel 11*a* and is inhaled by the user.

Also referring to FIG. 1, in some embodiments, the liquid storage component 13 includes a sleeve body 131 and a cover body 132. A bottom of the sleeve body 131 is sleeved on the fixing tube 121, and an annular cavity (i.e., the liquid storage cavity A) is formed between the sleeve body 131 and the fixing tube 121. It should be noted that, after the sleeve body 131 is sleeved on the fixing tube 121, the liquid inlet 121*a* on the fixing tube 121 is in communication with the liquid storage cavity A. In other words, the liquid inlet 121*a* is located on a portion of the fixing tube 121 where it can be soaked by the e-liquid, such that the e-liquid in the liquid storage cavity A can enter the fixing tube 121 through the liquid inlet 121*a*.

In some embodiments, the cover body 132 covers a top of the sleeve body 131, so as to seal the liquid storage cavity A. The cover body 132 has a through hole allowing the end 121*b* of the fixing tube 121 to extend through. Therefore, when the cover body 132 is covered at the top of the sleeve body 131, the end 121*b* of the fixing tube 121 communicates with the smoke channel 11*a* through the through hole on the cover body 132. The cover body 132 can be made of a soft silicone material, such that the cover body 132 has good sealing effects between the sleeve body 131 and the fixing tube 121.

Also referring to FIG. 1, in some embodiments, the power device 20 includes a housing 21, a stand 22, an air pressure sensor 23, a control circuit (not shown), and a battery 24.

In some embodiments, a bottom of the atomizing device 10 is inserted into the housing 21, so as to realize the assembly of the electronic cigarette. Of course, the atomizing device 10 can be assembled with the power device 20 by other detachable means such as threading or magnetic adsorption. For example, the stand 22 can be provided with a magnet member such as a magnet 27, such that when the atomizing device 10 is assembled to the power device 20, the atomizing device 10 can be fixed to the power device 20 by the magnetic force of the magnet 27.

In some embodiments, the atomizing device 10 and the power device 20 can implement an electrical connection between the battery 24 and the heating member 123 by using a contact means at the junction therebetween.

Specifically, the heating member 123 is connected to an electrical contact 15 through an electrical connector 123*a* such as a wire, and the electrical contact 15 is mounted on one end of the atomizing device 10 adjacent to the power device 20 through the mounting base 14. Correspondingly, the stand 22 is provided with a conductive probe 25 corresponding to the electrical contact 15, and the conductive probe 25 is electrically coupled to the battery 24. Therefore, after the atomizing device 10 and the power device 20 are assembled, the conductive probe 25 is in contact with the electrical contact 15 to realize the electrical connection between the heating member 123 and the battery 24.

Also referring to FIG. 1, the air pressure sensor 23 and battery 24 are located on the stand 22, and are assembled into the housing 21 together with the stand 22. The stand 22 and the housing 21 can be sealed by a sealing member 21*a* therebetween, such as a sealing ring. The battery 24 can be a rechargeable battery for multiple use, it has good endurance performance, and can be used for a long time to meet the long-term smoking requirements.

The housing 21 has an air inlet 20*a* corresponding to a bottom of the atomizing device 10. Specifically, a gap is formed between the bottom of the atomizing device 10 and the stand 22 of the power device 20 when the atomizing device 10 and the power device 20 are assembled. Therefore, when the air inlet 20*a* is located in a position corresponding to the gap, during the smoking process of the user, an external airflow can enter the gap between the atomizing device 10 and the power device 20 through the air inlet 20*a*. Correspondingly, the suction effect generated by the user's inhalation will form a negative pressure at the junction between the atomizing device 10 and the power device 20, such that the negative pressure can be detected by the air pressure sensor 23, and it is possible to know whether the user is using the electronic cigarette for smoking.

The control circuit is located in the housing 21. The air pressure sensor 23 can be electrically coupled to the control circuit, such that the control circuit can adjust the operation state according to the negative pressure detected by the air pressure sensor 23, that is, whether or not the atomizing device 10 heats or atomizes the e-liquid. For example, when the user does not inhale the smoke, there is little air flow at the junction between the atomizing device 10 and the power device 20, which is insufficient to form a negative pressure, such that the negative pressure detected by the air pressure sensor 23 will be lower than a preset threshold for the electronic cigarette operation, and the control circuit controls the electronic cigarette to be in an inactive state. Correspondingly, when the user inhales the smoke, the external air flows into the housing 21 through the air inlet 20*a* and forms a negative pressure at the junction between the atomizing device 10 and the power device 20, the air pressure sensor 23 detects that the negative pressure is higher than the preset threshold value for the electronic cigarette operation, such that the electronic cigarette operates to generate smoke for the user to smoke. According to this configuration, the control of the electronic cigarette is extremely simplified, and the smoke is generated by atomizing the e-liquid only when the user inhales.

In some embodiments, the stand 22 has a vent hole 23*a* in communication with the air pressure sensor 23. When the user inhales the smoke through the smoke channel 11*a*, a negative pressure is generated at the vent hole 23*a* due to the suction effect.

As shown in FIG. 1, the dashed arrows schematically illustrate the flow path of the airflow during use of the electronic cigarette. Specifically, when the user inhales smoke through the smoke channel 11*a*, the external air flows into the housing 21 through the air inlet 20*a*, and generates a suction effect to form a negative pressure at the vent hole 23*a*, such that the air pressure sensor 23 in communication with the vent hole 23*a* can detect the negative pressure generated by smoking of the user. The existence of the negative pressure indicates that the user is smoking, such that the control circuit adjusts the operation state of the electronic cigarette according to the negative pressure detected by the air pressure sensor 23, and only operates when the user is smoking. When the user is not smoking, no negative pressure is detected, or the detected negative pressure is lower than the preset threshold for the electronic cigarette operation, the electronic cigarette stops heating and atomizing the e-liquid, and this configuration makes the use of the electronic cigarette extremely convenient.

Figure 2:
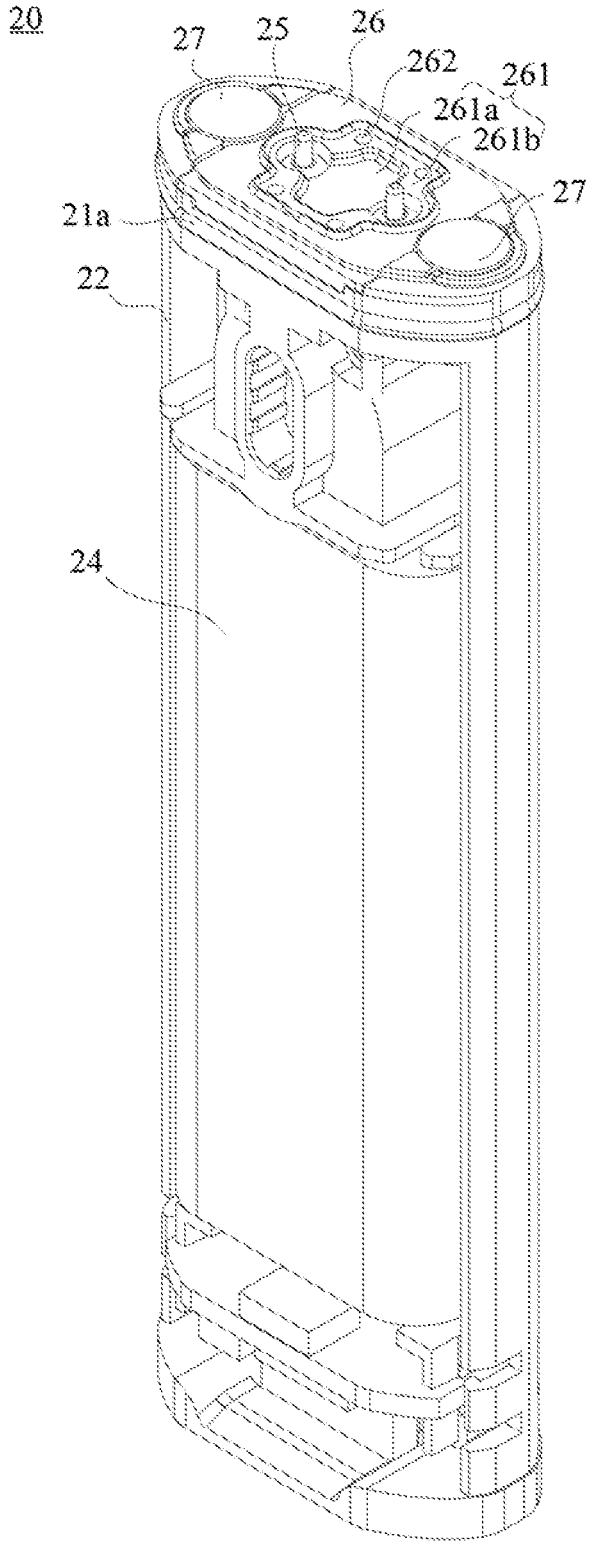
FIG. 2 is a perspective view of a power device of an electronic cigarette according to an embodiment without a housing.
Figure 3:
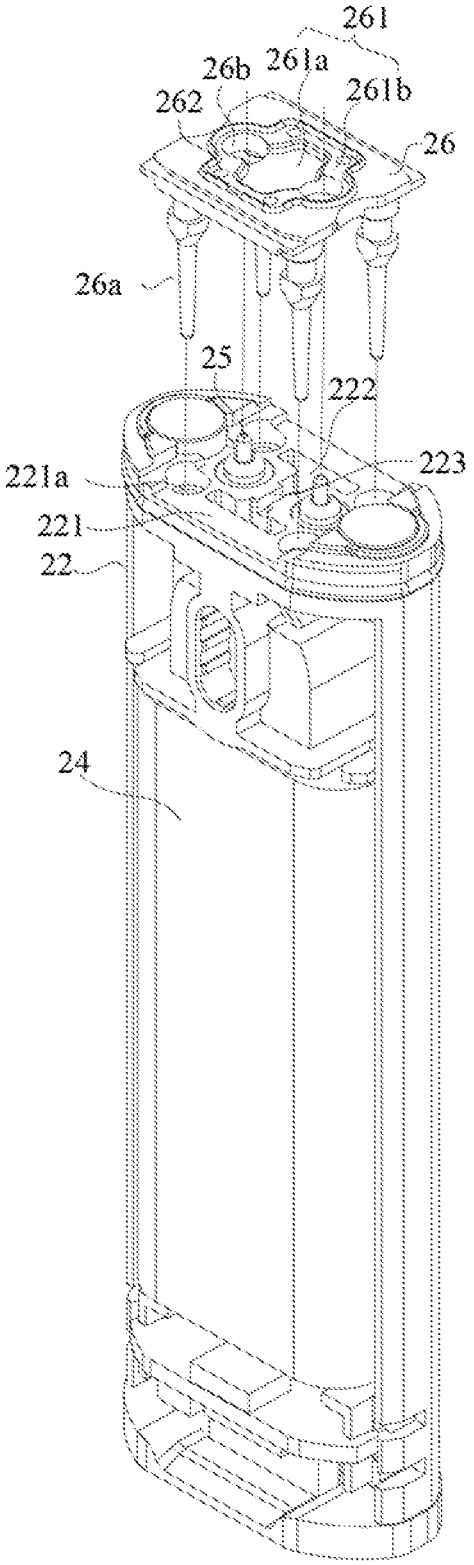
FIG. 3 is an exploded perspective view of the power device of FIG. 2.
Figure 4:
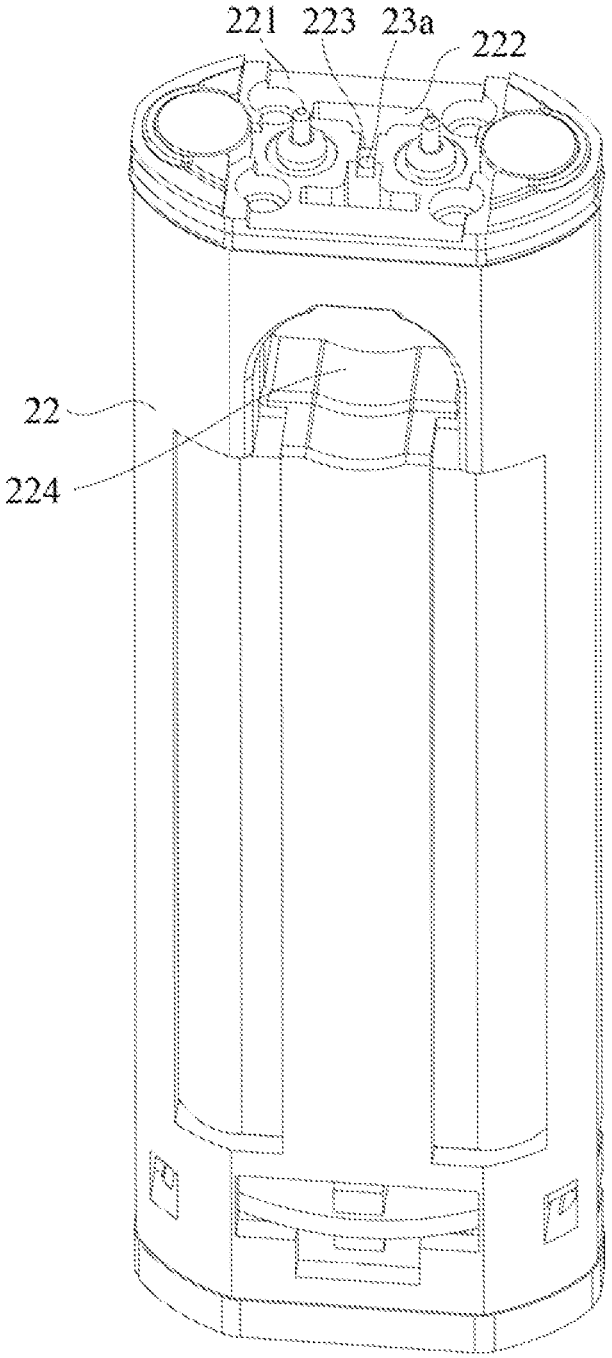
FIG. 4 is a perspective view of a stand according to another embodiment.

Referring to FIG. 2 to FIG. 4, in some embodiments, a liquid accumulating member 26 is located at the end of the stand 22 adjacent to the atomizing device 10. A side of the liquid accumulating member 26 adjacent to the atomizing device 10 forms a liquid accumulating cavity 261, such that when the atomizing device 10 and the power device 20 are assembled, the liquid accumulating member 26 is located between the atomizing device 10 and the power device 20, so as to store the e-liquid exuded from the atomizing device 10 (i.e., leakage liquid), thereby preventing the leakage liquid from entering the power device 20 and affecting the normal use of the electronic cigarette.

In some embodiments, the liquid accumulating member 26 can be made of a silicone material, such that, the liquid accumulating member 26 has a better sealing performance when it is mounted to the stand 22. For example, the liquid accumulating member 26 made of the silicone material can realize the sealing between the liquid accumulating member 26 and the stand 22, and the sealing between the liquid accumulating member 26 and the conductive probe 25.

As shown in FIG. 3, in some embodiments, the liquid accumulating member 26 is connected to the stand 22 by plug-in. The liquid accumulating member 26 is provided with four inserting pins 26*a* at one side thereof facing the stand 22, and four corresponding inserting holes 221*a* are provided on the stand 22. The numbers of the inserting pin 26*a* and the inserting hole 221*a* can be two, three, or more, as long as they are equal, such that the liquid accumulating member 26 can be easily assembled to the stand 22 by inserting the inserting pins 26*a* into the corresponding inserting holes 221*a*.

In addition, a mounting groove 221 is formed on top of the stand 22, such that when the liquid accumulating member 26 is mounted on the stand 22, it can be received in the mounting groove 221. Furthermore, when the atomizing device 10 is engaged with the power device 20, the liquid accumulating member 26 does not occupy the assembling space by protruding from the stand 22, such that the assembling clearance between the atomizing device 10 and the power device 20 is relatively less, the structure is more compact, and the overall volume of the electronic cigarette is reduced.

In some embodiments, the liquid accumulating member 26 has an extending hole 26*b* corresponding to the conductive probe 25, such that the conductive probe 25 can extend through the extending hole 26*b* and is exposed from the power device 20 when the liquid accumulating member 26 is connected to the stand 22. Therefore, after the atomizing device 10 and the power device 20 are assembled, the conductive probe 25 can abut against the electrical contact 15 to realize the electrical connection between the heating member 123 and the battery 24.

Referring to FIG. 2 and FIG, 3, the liquid accumulating cavity 261 includes a first liquid accumulating groove 261*a* and a second liquid accumulating groove 261*b* formed on the liquid accumulating member 26, and a stepped portion is formed between the grooves. The liquid accumulating member 26 has a through hole 262 in communication with the vent hole 23*a*, and the vent hole 23*a* and the through hole 262 are staggered with each other, so as to prevent the leakage liquid from entering the vent hole 23*a* via the through hole 262 and blocking the vent hole 23*a*. At the same time, since the through hole 262 is in communication with the vent hole 23*a*, the negative pressure generated at the junction between the atomizing device 10 and the power device 20 during smoking can be detected by the air pressure sensor 23 at the vent hole 23*a*, so as to ensure the normal operation of the electronic cigarette. It should be noted that, the number of the through hole 262 can be, but not limited to four, as shown in FIG. 2, the four through holes 262 are located at four corners of the second liquid accumulating groove 261*b*, respectively.

The position of the through hole 262 is not limited, and it can be provided according to actual needs, as long as the through hole 262 and the vent hole 23*a* are staggered with each other, such that the leakage liquid cannot flow into the vent hole 23*a* through the through hole 262. In the illustrated embodiment, as shown in FIG. 2, the through hole 262 is located in the second liquid accumulating groove 261*b*. In other embodiments, the through hole 262 can also be provided in the first liquid accumulating groove 261*a*.

As shown in FIG. 3, in some embodiments, two elongated liquid storage grooves 222 are formed on a top surface of the stand 22, and the two liquid storage grooves 222 are located under the through hole 262, so as to collect the e-liquid flown through the through hole 262. In the illustrated embodiment, since the through hole 262 is provided in the second liquid accumulating groove 261*b*, if the leakage liquid continues to flow to the liquid accumulating member 26 after the first liquid accumulating groove 261*a* is filled, the leakage liquid will flow into the liquid storage grooves 222 through the through hole 262 the liquid storage grooves 222 has a larger space to store more leakage liquid, so as to prevent the vent hole 23*a* from being blocked.

Referring to FIG. 4, in the illustrated embodiment, a connecting groove 223 in communication with the two liquid storage grooves 222 is provided at the top surface of the stand 22 where the vent hole 23*a* is located. In this way, when the liquid accumulating member 26 is assembled to the stand 22, the liquid accumulating member 26 will not block the vent hole 23*a*. Since the vent hole 23*a* is in communication with the liquid storage grooves 222 through the connecting groove 223, during the smoking, when the airflow entered from the air inlet 20*a* flows on the surface of the liquid accumulating member 26, the air between the liquid accumulating member 26 and the stand 22 can be sucked through the through hole 262, such that the vent hole 23*a* in communication with the liquid storage grooves 222 also has a corresponding suction effect so that the negative pressure can be detected by the air pressure sensor 23.

It should be noted that, in the aforementioned embodiment, the depth of the connecting groove 223 is less than the depth of the liquid storage groove 222, such that the leakage liquid will not flow into the connecting groove 223 and block the vent hole 23*a* on the connecting groove 223 when the liquid storage grooves 222 stores the leakage liquid. In the illustrated embodiment, during smoking, the airflow in the vent hole 23*a* can flow through the connecting groove 223 and the liquid storage grooves 222 in sequence, and then flow out through the through hole 262 on the liquid accumulating member 26, such that the air pressure sensor 23 in communication with the vent hole 23*a* can detect the negative pressure generated during smoking, and the control circuit can accurately adjust the operation state of the electronic cigarette according to the negative pressure detected by the air pressure sensor 23.

Referring to FIG. 1 and FIG. 4, in some embodiments, the stand 22 is provided with a mounting hole 224 for the air pressure sensor 23, the vent hole 23*a* extends into the mounting hole 224, such that when the air pressure sensor 23 is mounted in the mounting hole 224, the airflow in the vent hole 23*a* can reach the air pressure sensor 23. Therefore, during smoking, the air pressure sensor 23 can detect the negative pressure generated in the vent hole 23*a*, that is, the user is smoking through the smoke channel 11*a*. At this time, the control circuit will control the atomizing device 10 to be in the operation state and heat and atomize the e-liquid, so as to generate the smoke for the user to smoke.

The technical features of the embodiments described above can be arbitrarily combined. In order to make the description succinct, there is no describing of all possible combinations of the various technical features in the foregoing embodiments. It should be noted that there is no contradiction in the combination of these technical features which should be considered as the scope of the description.

Although the present disclosure is illustrated and described herein with reference to specific embodiments, the present disclosure is not intended to be limited to the details shown. It is to be noted that, various modifications may be made in the details within the scope and range of equivalents of the claims and without departing from the present disclosure. Therefore, the protection scope of the present disclosure shall be subject to the protection scope of the claims.

What is claimed is:

1. An electronic cigarette, comprising:

an atomizing device; and a power device connected to the atomizing device and configured to supply power to the atomizing device, such that the atomizing device atomizes the e-liquid and generate smoke, wherein the power device comprises a stand and a liquid accumulating member located at an end of the stand adjacent to the atomizing device, the liquid accumulating member is provided with a liquid storage cavity on a side thereof adjacent to the atomizing device, the liquid accumulating cavity being configured to store the e-liquid exuded by the atomizing device.

2. The electronic cigarette according to claim 1, wherein the liquid accumulating member is made of a silicone material.

3. The electronic cigarette according to claim 1, wherein the heating member is at least one selected from the group consisting of a heating coating, a heating circuit, a heating sheet, and a heating mesh.

4. The electronic cigarette according to claim 1, wherein the atomizing device is detachably connected to the power device.

5. The electronic cigarette according to claim 1, wherein the liquid accumulating member is provided with an inserting pin on a side thereof facing the stand, the stand is provided with an inserting hole, the inserting pin is inserted into the inserting hole, such that the liquid accumulating member is connected to the stand.

6. The electronic cigarette according to claim 5, wherein the stand is provided with a mounting groove, and the liquid accumulating member is embedded in the mounting groove.

7. The electronic cigarette according to claim 1, wherein the power device further comprise:

a housing accommodating a part of the atomizing device, the housing, having an air inlet corresponding to a bottom of the atomizing device;

a control circuit located in the housing; and an air pressure sensor located on the stand and electrically coupled to the control circuit, the stand being provided with a vent hold in communication with the air pressure sensor, wherein when an external airflow enters the housing from the air inlet and flows to the atomizing device, a negative pressure is generated at the air inlet, the air pressure sensor is configured to detect the negative pressure at the vent hole, and the control circuit is configured to adjust an operation state of the electronic cigarette according to the negative pressure detected by the air pressure sensor.

8. The electronic cigarette according to claim 7, wherein the stand is provided with a mounting hole in communication with the vent hole, and the air pressure sensor is located in the mounting hole.

9. The electronic cigarette according to claim 7, wherein the power device further comprises a sealing member located between the stand and the housing.

10. The electronic cigarette according to claim 7, wherein the liquid storage cavity comprises a first liquid accumulating groove and a second liquid accumulating groove formed on the liquid accumulating member, a stepped portion is formed between the first liquid accumulating groove and the second liquid accumulating groove.

11. The electronic cigarette according to claim 10, wherein the liquid accumulating member is provided with a through hole at the second liquid accumulating groove, the through hole is in communication with the vent hole, and the through hole and the vent hole are staggered with each other.

12. The electronic cigarette according to claim 11, wherein the stand forms a liquid storage groove under the through hole to collect the e-liquid flown through the through hole.

13. The electronic cigarette according to claim 12, wherein the stand is provided with a connecting groove on an end surface thereof where the vent hole is located in communication with the groove, and a depth of the connecting groove is less than a depth of the groove.

14. The electronic cigarette according to claim 1, wherein the atomizing device comprises a casing, an atomizing component, and a liquid storage component, the atomizing component and the liquid storage component are located in the casing, the casing has a smoke channel for smoke to flow out.

15. The electronic cigarette according to claim 14, wherein the liquid storage component comprises a sleeve body and a cover body, a bottom of the sleeve body is sleeved on the fixing tube, an annular cavity is formed between the sleeve body and the fixing tube, the cover body is covered on a top of the sleeve body to seal the cavity.

16. The electronic cigarette according to claim 14, wherein the atomizing component comprises a fixing tube, a liquid absorbing member, and a heating member, the liquid absorbing member is located in the fixing tube and is configured to absorb the e-liquid, the heating member is located in the liquid absorbing member and is configured to heat and atomize the e-liquid absorbed by the liquid absorbing member.

17. The electronic cigarette according to claim 16, wherein an end of the fixing tube away from the power device shrinks and is in communication with the smoke channel.

18. The electronic cigarette according to claim 16, wherein the liquid absorbing member is a liquid absorbing cotton or a porous ceramic body.

19. The electronic cigarette according to claim 16, wherein the heating member is connected to an electrical contact located on the atomizing device adjacent to the power device, and the stand is provided with a conductive probe corresponding to the electrical contact.

20. The electronic cigarette according to claim 19, wherein the liquid accumulating member is provided with an extending hole corresponding to the conductive probe, such that the conductive probe extends from the extending hole and is exposed from the power device when the liquid accumulating member is connected to the stand.

* * * * *